US005411265A

United States Patent [19]

Falco

[11] Patent Number: 5,411,265

[45] Date of Patent: May 2, 1995

[54] AERODYNAMIC GOLF CHIPPING TARGET

[76] Inventor: John D. Falco, 242 Steelmanville Rd., Linwood, N.J. 08221

[21] Appl. No.: 231,520

[22] Filed: Apr. 22, 1994

[51] Int. Cl.[6] ..... A63B 69/36; A63H 27/00

[52] U.S. Cl. ..... 273/181 A; 273/181 F; 273/424

[58] Field of Search ..... 273/424, 425, 178 R, 273/181 A, 181 F, 180

[56] References Cited

U.S. PATENT DOCUMENTS

| | | | |
|---|---|---|---|
| 1,063,119 | 5/1913 | Clifford | 273/180 X |
| 2,121,270 | 6/1938 | Streich | 273/180 |
| 3,843,136 | 10/1974 | Buenzle | 273/180 X |
| 4,176,843 | 12/1979 | DeWitt | 273/424 |
| 4,290,226 | 9/1981 | Stauffer | 273/424 |

*Primary Examiner*—George J. Marlo
*Attorney, Agent, or Firm*—Norman E. Lehrer; Jeffrey S. Ginsberg

[57] ABSTRACT

An aerodynamic golf chipping target is comprised of a body having a disc-shaped upper surface and a circumferential portion surrounding the upper surface. The upper surface has a circular hole formed in the center thereof for receiving a golf ball. The hole is defined by a rim. Netting is loosely secured beneath the rim around its periphery so that a ball entering the hole will become entrapped therein. The circumferential portion has a gradual slope and extends downwardly from the upper surface. The bottom of the circumferential portion defines a circular opening. The chipping target has an aerodynamic shape so that it glides a substantial distance when thrown through the air.

9 Claims, 1 Drawing Sheet

AERODYNAMIC GOLF CHIPPING TARGET

BACKGROUND OF THE INVENTION

The present invention is directed toward a golf chipping target and, more particularly, toward a golf chipping target adapted to entrap a golf ball therein. The present invention is particularly suited to be thrown through the air and land in an upright position.

The game of golf has enjoyed increasing popularity over the years. Millions of people in the United States alone play the game one or more times per year. It is a difficult game to master and requires many hours of practice to become proficient. An especially difficult aspect of golf involves hitting the ball when it is located a relatively short distance from the green, i.e. within 100 yards. This is commonly referred to as the short game. It is desirable to hit the ball with a high trajectory when it is so located.

Golf is both relatively expensive and time consuming as compared to other sports. Many people simply do not have the time or money to play a full round of golf (18 holes) on a regular basis. Moreover, even if the golfer is fortunate enough to be able to frequently play the game, it is difficult for him to obtain the required practice while actually playing on a course. This is because the golfer cannot hit ball after ball while on a particular hole as other golfers are usually waiting to tee off behind him and would not tolerate such a delay.

It is appreciated that a number of driving ranges presently exist that enable a golfer to consecutively hit one ball after another. However, a drawback to such practice areas is that driving range facilities do not adequately provide the variety of play associated with the game of golf. For example, holes are not placed at various locations to allow the golfer to improve his accuracy by chipping shots toward a particular hole. In addition, driving ranges are often not conveniently located.

It is a common routine for golfers to practice their strokes on virtually any open grass covered area. Some golfers will dig a number of holes at various positions in the ground. They can then practice their game, especially their short game, by trying to loft balls into the holes. However, this can become boring as there is no variety in the location of the holes once they are dug.

Accordingly, over the years many different types of movable targets have been developed to enable a golfer to place the target on the ground and then pitch or chip a golf ball into the target after moving some distance away. The golfer is able to control the location of the hole and the distance he will be from the hole when hitting the golf ball. See, for example, U.S. Pat. Nos. 1,063,119, 1,540,350 and 3,752,482. A common drawback to all of these prior devices is that they require the golfer to physically pick up the practice device, place it at a desired location, walk some distance away from the hole and then pitch a ball into the hole. The golfer can not simply toss the target through the air and then hit a ball from the position he was standing in when the target was thrown.

SUMMARY OF THE INVENTION

The present invention is designed to overcome the deficiencies of the prior art discussed above. It is an object of this invention to provide a golf chipping target that is adapted to receive balls therein and prevent them from bouncing out or escaping when played into.

It is a further object of this invention to provide a golf chipping target that is adapted to be thrown through the air and land in a substantially upright position on the ground.

In accordance with the illustrative embodiments, demonstrating features and advantages of the present invention, there is provided a golf chipping target that is comprised of a body having a disc-shaped upper surface and a circumferential portion surrounding the upper surface. The circumferential portion has a gradual slope and extends downwardly from the upper surface. The bottom of the circumferential portion defines a circular opening. Accordingly, the chipping target has an aerodynamic shape so that it glides or flies a substantial distance when thrown through the air.

The upper surface has a circular hole formed in the center thereof for receiving a golf ball. The hole is defined by a rim. Netting is loosely secured beneath the rim around its periphery. The netting extends downwardly from the upper surface to a position just above the bottom of the circumferential portion so that a ball entering the hole will be entrapped therein.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
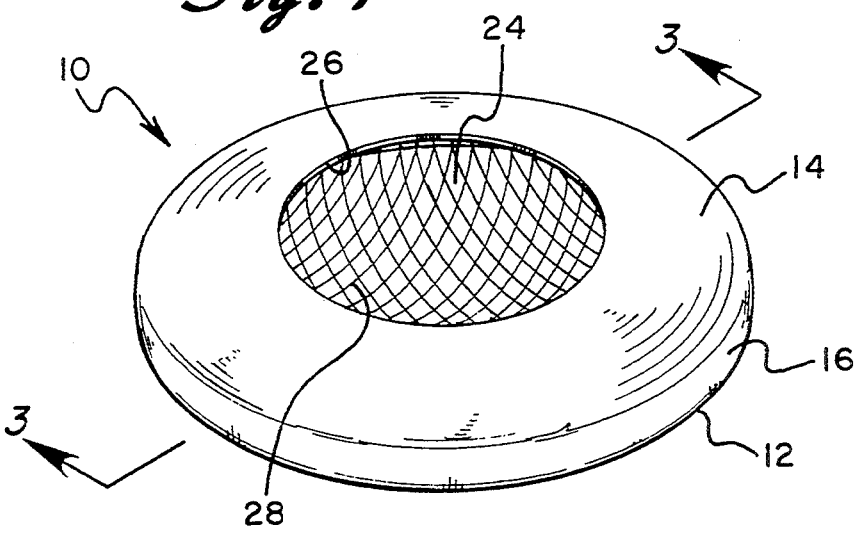
FIG. 1 is perspective view showing the preferred embodiment of the present invention.

Referring now to the drawings in detail wherein like reference numerals have been used throughout the various figures to designate like elements, there is shown in FIG. 1 a golf chipping target constructed in accordance with the principles of the present invention and designated generally as 10.

Figure 3:
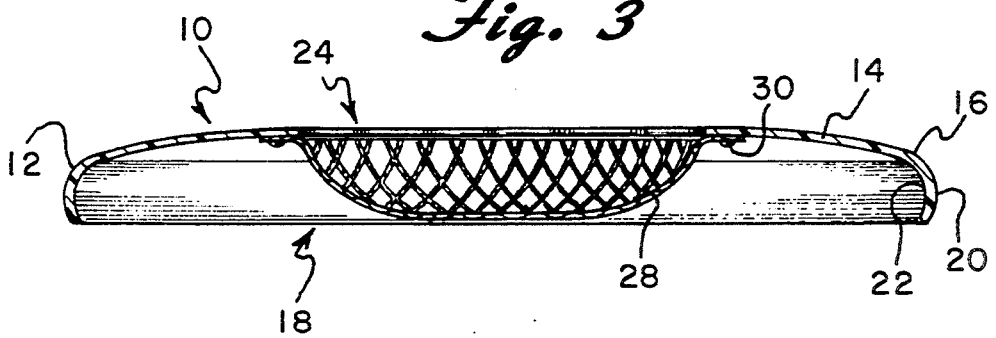
FIG. 3 is a cross-sectional view of the golf chipping target taken along lines 3—3 of FIG. 1.

The golf chipping target 10 comprises a body 12 having a disc-shaped upper surface 14 and a circumferential portion 16 surrounding the upper surface 14. The bottom of circumferential portion 16 defines a circular opening 18 as shown in FIG. 3. The body 12 is preferably made of plastic, however, it can be made of other material. The circumferential portion 16 has gradual slope extending downwardly from said upper surface 14 and inwardly toward circular opening 18 so that a convex side 20 and a concave side 22 are formed. The upper surface 14 has a hole 24 formed through the center thereof for receiving a golf ball. The hole 24 is defined by a rim 26.

With the exception of the hole 24, the target 10 thus far described is substantially the same shape and size as a flying disc sold by Wham-O Mfg. Co. under the name FRISBEE described in U.S. Pat. No. 3,359,678. The aerodynamic shape of the same allows for controlled flight through the air for a substantial distance.

Flexible netting 28 is secured to the underside of upper surface 14 around the periphery of rim 26 so that it loosely hangs therefrom (see FIG. 3). The netting 28 can by attached by gluing the same to the rim 26 or in other ways such as by tacking the netting to the rim as shown at 30. The netting extends below the rim 26 to a position slightly above the bottom of circumferential portion 16. Accordingly, when a ball is lofted into the hole 24 it is trapped in the netting 28. There is some slack in the netting 28 so that the downward force of the ball causes it to slightly give. However, in the preferred embodiment, the ball does not cause the netting to extend below the bottom of the circumferential portion 16. Therefore, a ball lofted into hole 18 will be trapped in the netting 28 instead of coming into contact with the ground and bouncing out of the hole 24. The netting 28 is preferably made of nylon, however it can be made of knitted string, canvas or other suitable material.

In an alternate embodiment, a cup may be inserted in hole 24 instead of netting 28. A layer of elastic material such as sponge or rubber can be placed on the bottom of the cup to prevent a ball that has been lofted into the cup from hitting a rigid surface and bouncing out.

To facilitate an understanding of the principles associated with the foregoing apparatus, its operation will now be briefly described. A golfer desiring to use the golf chipping target 10 will grasp it with his thumb on the convex side 20 of the target and one or more fingers on the concave side 22. Throwing is accomplished by having the user retract his arm across his body. Next, his arm is uncoiled and the golfer's wrist is snapped causing the target to fly through the air toward a certain location. Air flow contacting the underside of upper surface 14 causes the target to remain airborne for a significant amount of time. The distance the golf chipping target 10 will travel depends on the release point of the target and how hard the user's wrist is snapped. The aerodynamic shape of the golf chipping target 10 causes it to land in a substantially upright position if thrown in the manner described above.

Figure 2:
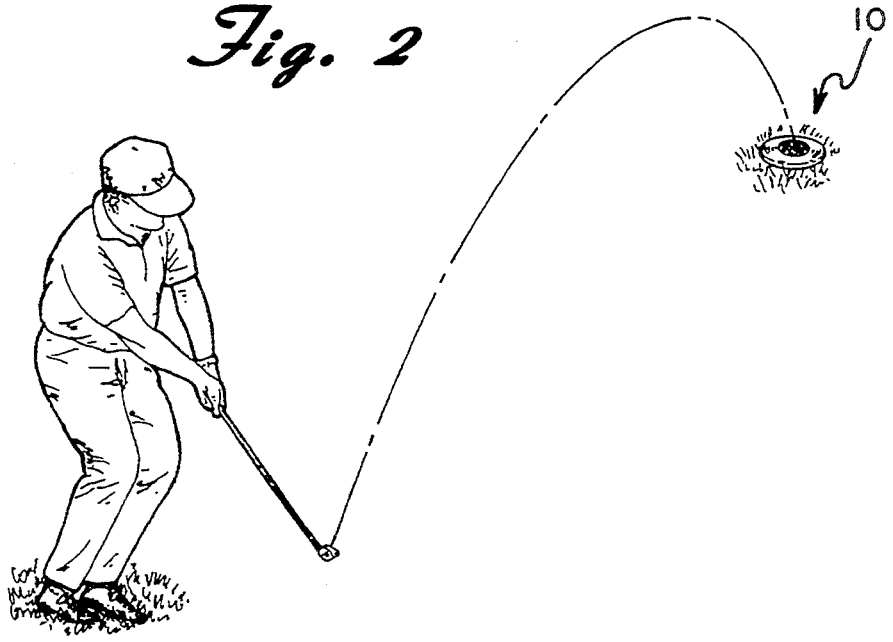
FIG. 2 shows a golfer pitching a golf ball into the golf chipping target.

After the golf chipping target 10 has landed in a substantially upright position it is ready for use. A golfer, who is preferably located 110 yards or less from the target, will hit golf balls toward the golf chipping target with the intention of having the balls land in the hole 24 formed in the upper surface 14 of body 12 (see FIG. 2). After the golfer has hit one or more golf balls, he will walk over to the target, pick up the golf balls and once again toss the target through the air to a new location. The golfer can then hit golf balls into the newly positioned target without any additional walking.

The present invention may be embodied in other specific forms without departing from the spirit or essential attributes thereof and accordingly reference should be made to the appended claims rather than to the foregoing specification as indicating the scope of the invention.

What is claimed is:

1. A golf chipping target adapted to be thrown through the air comprising a body having a disc-shaped upper surface and a circumferential portion surrounding the upper surface, said circumferential portion extending downwardly from said upper surface, said upper surface having a hole formed through the center thereof, and netting secured around the periphery of said hole, said netting loosely banging from the underside of said upper surface to a position slightly above the bottom of said circumferential portion so that a golf ball entering said hole will become entrapped therein.

2. The golf chipping target of claim 1 wherein the bottom of said circumferential portion defines a circular opening, said circumferential portion extending inwardly toward said circular opening.

3. The golf chipping target as claimed in claim 1 wherein said netting is secured to the underside of said upper surface.

4. The golf chipping target of claim 1 wherein said body is comprised of plastic.

5. The golf chipping target of claim 1 wherein said netting is comprised of nylon.

6. A golf chipping target adapted to be thrown through the air comprising a body having a disc-shaped upper surface and a circumferential portion surrounding said upper surface, said circumferential portion extending downwardly from said upper surface, said upper surface having a hole formed through the center thereof, and means fitted in said hole for receiving and holding a golf ball therein, said receiving and holding means being adapted to hold at least a portion of said golf ball below the underside of said upper surface.

7. The golf chipping target of claim 6 wherein the bottom of said circumferential portion defines a circular opening, said circumferential portion extending inwardly toward said circular opening.

8. The golf chipping target of claim 6 wherein said body is comprised of plastic.

9. The golf chipping target of claim 6 wherein said means for receiving and holding a golf ball is comprised of a flexible member extending downwardly below said upper surface.

* * * * *

UNITED STATES PATENT AND TRADEMARK OFFICE

CERTIFICATE OF CORRECTION

PATENT NO. : 5,411,265

DATED : May 2, 1995

INVENTOR(S) : John D. Falco

It is certified that error appears in the above-identified patent and that said Letters Patent is hereby corrected as shown below:

Column 4, line 15, "banging" should read --hanging--

Signed and Sealed this

Fifth Day of September, 1995

*Attest:*

*Attesting Officer*

BRUCE LEHMAN

*Commissioner of Patents and Trademarks*